US009175893B2

(12) United States Patent
Junge et al.

(10) Patent No.: US 9,175,893 B2
(45) Date of Patent: Nov. 3, 2015

(54) REFRIGERATOR

(75) Inventors: Brent Alden Junge, Evansville, IN (US); Stephanos Kyriacou, Louisville, KY (US); Kristin Marie Weirich, Louisville, KY (US); Umakant Suresh Katu, Hyderabad (IN); Alan Joseph Mitchell, Louisville, KY (US)

(73) Assignee: General Electric Company, Schenectady, NY (US)

( * ) Notice: Subject to any disclaimer, the term of this patent is extended or adjusted under 35 U.S.C. 154(b) by 1089 days.

(21) Appl. No.: 12/796,776

(22) Filed: Jun. 9, 2010

(65) Prior Publication Data

US 2010/0242526 A1 Sep. 30, 2010

Related U.S. Application Data

(63) Continuation-in-part of application No. 12/268,090, filed on Nov. 10, 2008.

(51) Int. Cl.

| | |
|---|---|
| ***F25D 17/04*** | (2006.01) |
| ***F25C 5/00*** | (2006.01) |
| ***F25D 17/06*** | (2006.01) |
| *F25D 21/08* | (2006.01) |
| *F25D 23/04* | (2006.01) |

(52) U.S. Cl.

CPC ..... *F25C 5/005* (2013.01); *F25D 17/065* (2013.01); *F25D 21/08* (2013.01); *F25D 23/04* (2013.01)

(58) Field of Classification Search

CPC ..... F25D 23/061; F25D 23/006; D25C 1/00
USPC ..... 62/443–445; 165/171

See application file for complete search history.

(56) References Cited

U.S. PATENT DOCUMENTS

| | | | | |
|---|---|---|---|---|
| 3,433,300 | A * | 3/1969 | Pasternak | 165/151 |
| 3,568,465 | A * | 3/1971 | Jung | 62/419 |
| 4,300,359 | A | 11/1981 | Koeneman et al. | |
| 4,665,708 | A | 5/1987 | Tate, Jr. et al. | |
| 4,719,765 | A | 1/1988 | Hooper et al. | |
| 4,739,233 | A | 4/1988 | Marcade | |

(Continued)

FOREIGN PATENT DOCUMENTS

| | | | | |
|---|---|---|---|---|
| GB | 1493746 | | 11/1977 | |
| JP | 11294928 | A * | 10/1999 | F25D 3/00 |
| WO | 2006067378 | A1 | 6/2006 | |

OTHER PUBLICATIONS

English Translation of JP 11294928.*

(Continued)

*Primary Examiner* — Cheryl J Tyler
*Assistant Examiner* — Elizabeth Martin
(74) *Attorney, Agent, or Firm* — Dority & Manning, P.A.

(57) ABSTRACT

A refrigerator includes a main body defining a compartment, the compartment having an access opening and a first wall, a door supported by the main body for selectively closing at least part of the access opening, a sub-compartment on the door, the sub-compartment comprising a second wall having an opening, a heat exchanger supported by the first wall and positioned so that when the door is closed the heat exchanger is exposed to an interior of the sub-compartment through the opening, and a refrigeration system having a working medium for cooling the heat exchanger, where the heat exchanger further includes one or more segments of the refrigeration system attached to a heat exchanging plate.

18 Claims, 17 Drawing Sheets

(56) References Cited

U.S. PATENT DOCUMENTS

| | | | | |
|---|---|---|---|---|
| 4,741,169 | A | 5/1988 | Linstromberg | |
| 4,754,615 | A | 7/1988 | Linstromberg | |
| 4,756,165 | A | 7/1988 | Chestnut et al. | |
| 4,787,216 | A | 11/1988 | Chesnut et al. | |
| 4,799,362 | A | 1/1989 | Chestnut | |
| 4,800,935 | A | 1/1989 | Buchser et al. | |
| 4,833,894 | A | 5/1989 | Chesnut | |
| 4,942,979 | A | 7/1990 | Linstromberg et al. | |
| 4,997,109 | A | 3/1991 | Carper | |
| 5,033,273 | A | 7/1991 | Buchser et al. | |
| 5,050,777 | A | 9/1991 | Buchser | |
| 5,077,985 | A | 1/1992 | Buchser et al. | |
| D324,869 | S | 3/1992 | Carper | |
| 5,117,654 | A | 6/1992 | Steffenhagen | |
| 5,139,183 | A | 8/1992 | Buchser et al. | |
| 5,160,094 | A | 11/1992 | Willis et al. | |
| 5,187,948 | A | 2/1993 | Frohbieter | |
| 5,203,399 | A * | 4/1993 | Koizumi | 165/104.33 |
| 5,269,154 | A | 12/1993 | Schmidt | |
| 5,272,888 | A | 12/1993 | Fisher et al. | |
| 5,297,394 | A | 3/1994 | Frohbieter et al. | |
| 5,329,786 | A | 7/1994 | Willis et al. | |
| 6,050,097 | A | 4/2000 | Nelson et al. | |
| 6,082,130 | A | 7/2000 | Pastryk et al. | |
| 6,125,641 | A | 10/2000 | Kim et al. | |
| 6,148,624 | A | 11/2000 | Bishop et al. | |
| 6,161,390 | A | 12/2000 | Kim | |
| 6,242,714 | B1 | 6/2001 | Narumiya et al. | |
| D447,493 | S | 9/2001 | Shelley et al. | |
| 6,286,324 | B1 | 9/2001 | Pastryk et al. | |
| 6,314,745 | B1 | 11/2001 | Janke et al. | |
| 6,351,955 | B1 | 3/2002 | Oltman et al. | |
| 6,397,618 | B1 * | 6/2002 | Chu et al. | 62/259.2 |
| 6,401,478 | B2 | 6/2002 | Dasher et al. | |
| 6,425,259 | B2 | 7/2002 | Nelson et al. | |
| 6,481,235 | B2 | 11/2002 | Kwon | |
| 6,484,529 | B2 | 11/2002 | Dasher et al. | |
| 6,532,751 | B1 | 3/2003 | Schenk et al. | |
| 6,539,742 | B2 | 4/2003 | Mitchell et al. | |
| 6,571,567 | B2 | 6/2003 | An et al. | |
| 6,588,227 | B2 | 7/2003 | Kim et al. | |
| 6,637,217 | B2 | 10/2003 | Kim et al. | |
| 6,674,642 | B1 * | 1/2004 | Chu et al. | 361/679.27 |
| 6,705,091 | B1 | 3/2004 | Kim et al. | |
| 6,725,685 | B2 | 4/2004 | Kang | |
| 6,789,614 | B2 * | 9/2004 | Sin et al. | 165/151 |
| 6,804,974 | B1 | 10/2004 | Voglewede et al. | |
| 6,823,689 | B2 | 11/2004 | Kim et al. | |
| 6,857,279 | B2 | 2/2005 | Kim et al. | |
| 6,901,764 | B2 | 6/2005 | An et al. | |
| 6,904,765 | B2 | 6/2005 | Lee et al. | |
| 6,910,526 | B1 * | 6/2005 | Sokolean | 165/56 |
| 7,017,354 | B2 | 3/2006 | Lee et al. | |
| 7,017,363 | B2 | 3/2006 | Lee et al. | |
| 7,017,364 | B2 | 3/2006 | Lee et al. | |
| 7,040,111 | B2 | 5/2006 | Lee et al. | |
| 7,080,518 | B2 | 7/2006 | Kim et al. | |
| 7,111,473 | B2 | 9/2006 | Chung et al. | |
| 7,124,602 | B2 * | 10/2006 | Lee et al. | 62/451 |
| 7,131,280 | B2 | 11/2006 | Voglewede et al. | |
| 7,134,292 | B2 | 11/2006 | Oh | |
| 7,185,507 | B2 | 3/2007 | Maglinger et al. | |
| 7,188,479 | B2 | 3/2007 | Anselmino et al. | |
| 7,210,299 | B2 | 5/2007 | Yang | |
| 7,210,307 | B2 | 5/2007 | Kuehl et al. | |
| 7,213,638 | B2 * | 5/2007 | Seiler et al. | 165/148 |
| 7,219,509 | B2 | 5/2007 | Pastryk et al. | |
| 7,222,497 | B2 | 5/2007 | An et al. | |
| 7,228,702 | B2 | 6/2007 | Maglinger et al. | |
| 7,228,703 | B2 | 6/2007 | Kim et al. | |
| 7,237,393 | B2 | 7/2007 | Chung et al. | |
| 7,257,962 | B2 | 8/2007 | Son | |
| 7,263,854 | B2 | 9/2007 | Lee et al. | |
| 7,266,890 | B2 * | 9/2007 | Cieslik et al. | 29/890.038 |
| 7,266,951 | B2 | 9/2007 | Anselmino et al. | |
| 7,266,972 | B2 | 9/2007 | Anselmino et al. | |
| 7,272,949 | B2 | 9/2007 | Lee et al. | |
| 7,278,275 | B2 | 10/2007 | Voglewede et al. | |
| 7,278,277 | B2 | 10/2007 | Son | |
| 7,318,323 | B2 | 1/2008 | Tatsui et al. | |
| 7,607,312 | B2 | 10/2009 | Wetekamp et al. | |
| 7,614,244 | B2 * | 11/2009 | Venkatakrishnan et al. | 62/187 |
| 7,703,299 | B2 * | 4/2010 | Schlosser et al. | 62/347 |
| 7,721,561 | B2 | 5/2010 | Kim | |
| 2006/0086128 | A1 | 4/2006 | Maglinger et al. | |
| 2006/0086132 | A1 | 4/2006 | Maglinger et al. | |
| 2006/0108109 | A1 * | 5/2006 | Romero-Beltran | 165/171 |
| 2007/0119193 | A1 | 5/2007 | Davis et al. | |
| 2008/0127670 | A1 | 6/2008 | Tikhonov et al. | |
| 2008/0156009 | A1 | 7/2008 | Cur et al. | |
| 2009/0260371 | A1 * | 10/2009 | Kuehl et al. | 62/79 |
| 2009/0293501 | A1 * | 12/2009 | Kulkarni et al. | 62/3.63 |

OTHER PUBLICATIONS

Office action issued in connection with related U.S Appl. No. 12/877,131 dated Apr. 10, 2014.

* cited by examiner

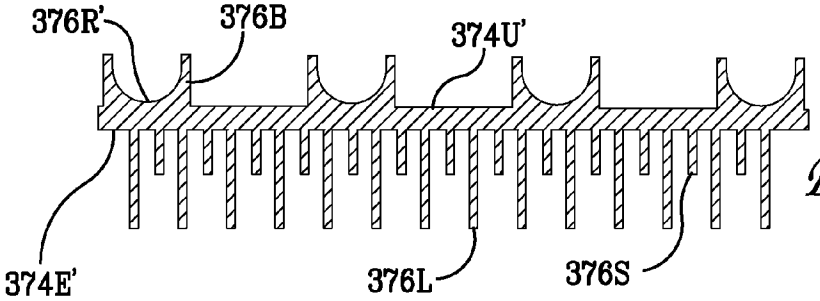
FIG. 11
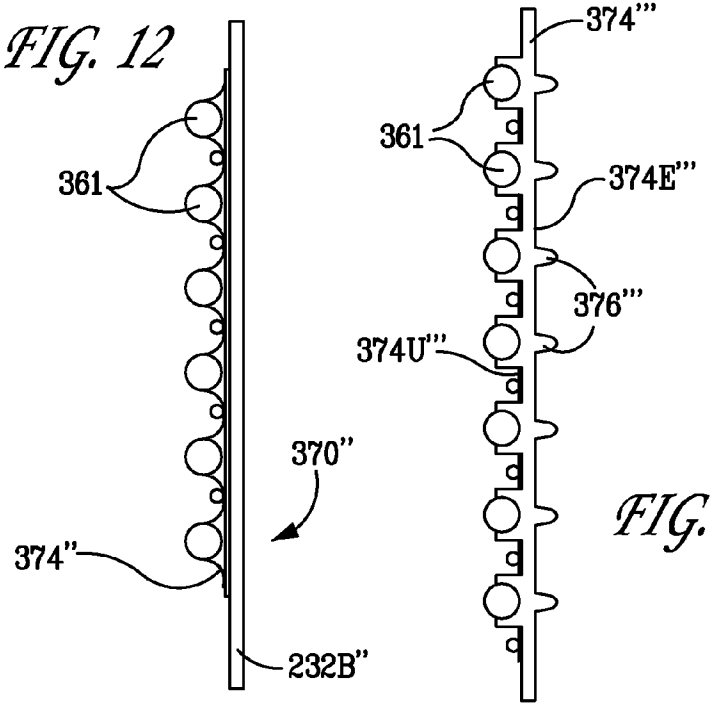
FIG. 12
FIG. 13
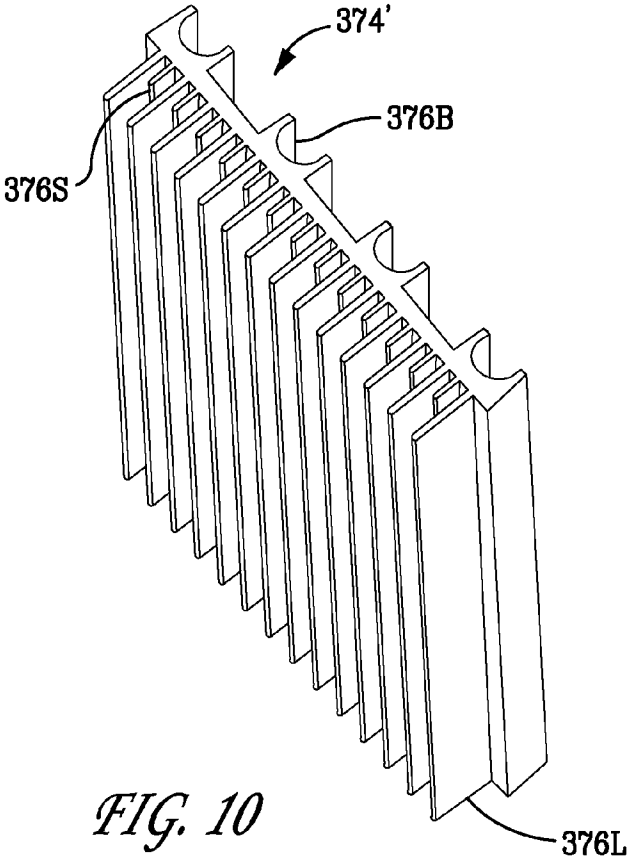
FIG. 10

REFRIGERATOR

CROSS REFERENCE TO RELATED APPLICATIONS

This application is a continuation-in-part application of application Ser. No. 12/268,090, filed on Nov. 10, 2008, the contents of which are incorporated herein by reference.

BACKGROUND OF THE INVENTION

The presently disclosed embodiments relate generally to a refrigerator. More particularly, the disclosed embodiments relate to a "bottom freezer" type refrigerator having a sub-compartment on the door for the top mounted fresh food compartment.

Generally, a refrigerator includes a freezer compartment and a fresh food compartment, which are partitioned from each other to store various foods at low temperatures in appropriate states for a relatively long time.

It is now common practice in the art of refrigerators to provide an automatic icemaker. In a "side-by-side" type refrigerator where the freezer compartment is arranged to the side of the fresh food compartment, the icemaker is usually disposed in the freezer compartment, and ice is delivered through an opening on the door for the freezer compartment. In this arrangement, ice is formed by freezing water with cold air in the freezer compartment, the air being made cold by the refrigeration system of the refrigerator, which includes an evaporator disposed in the freezer compartment.

In a "bottom freezer" type refrigerator where the freezer compartment is arranged below or beneath a top mounted fresh food compartment, convenience necessitates that the icemaker is disposed in a thermally insulated sub-compartment mounted on the door for the top mounted fresh food compartment, and ice is delivered through an opening on the door for the fresh food compartment. In such an arrangement provision must be made for providing adequate cooling to the sub-compartment to enable the icemaker to form ice and for the ice to be stored.

In one approach, the cold air in the freezer compartment is used to cool the icemaker. More specifically, the cold air in the freezer compartment, preferably the cold air around the evaporator in the freezer compartment, is circulated through the sub-compartment via a duct loop to maintain the icemaker in the sub-compartment at a temperature below the freezing point of water during operation. In this arrangement, a substantial portion of the duct loop is embedded in the insulation material of the sidewall of the main body of the refrigerator. The duct itself needs to have a sufficiently large cross-section to ensure that a sufficient amount of cold air can be delivered to and from the sub-compartment. However, the duct sometimes adversely reduces the thickness of the insulation material so that multiple heaters are needed in order to prevent the formation of condensation on the external surface of the main body. Using the heaters increases the energy consumption of the refrigerator. In addition, both the heaters and the duct loop increase the manufacturing cost.

In another approach, a liquid coolant in the nature of a mixture of propylene glycol and water is used to cool the icemaker. The liquid coolant is cooled by the cold air in the freezer compartment, and then is circulated to and from the icemaker in the sub-compartment through a circulation loop by a pump. The circulation loop needs to be liquid-tight. This is especially true with respect to the section of the circulation loop that extends between the main body of the refrigerator and the sub-compartment on the door for the fresh food compartment. This approach provides good cooling results, but it complicates the maintenance and/or repair process when the door for the fresh food compartment needs to be removed from the main body of the refrigerator.

In either approach, the working medium, be it chilled air or a liquid coolant, has to be delivered into, and removed from the sub-compartment.

BRIEF DESCRIPTION OF THE INVENTION

As described herein, the exemplary embodiments disclosed herein overcome one or more of the above or other disadvantages known in the art.

The presently disclosed embodiments are directed to a refrigerator including a main body defining a compartment, the compartment having an access opening and a first wall, a door supported by the main body for selectively closing at least part of the access opening, a sub-compartment on the door, the sub-compartment comprising a second wall having an opening, a heat exchanger supported by the first wall and positioned so that when the door is closed the heat exchanger is exposed to an interior of the sub-compartment through the opening, and a refrigeration system having a working medium for cooling the heat exchanger, where the heat exchanger further includes one or more segments of the refrigeration system attached to a heat exchanging plate.

These and other aspects and advantages of the exemplary embodiments disclosed herein will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

BRIEF DESCRIPTION OF THE DRAWINGS

In the drawings:

FIG. 10 is a perspective view of a heat exchanger in accordance with a second exemplary embodiment of the invention;

FIG. 11 is an enlarged cross-sectional view of the heat exchanger of FIG. 10;

FIG. 12 shows a heat exchanger in accordance with a third exemplary embodiment of the invention;

FIG. 13 shows a heat exchanger in accordance with a fourth exemplary embodiment of the invention;

DETAILED DESCRIPTION OF THE EXEMPLARY EMBODIMENTS OF THE INVENTION

Figure 1:
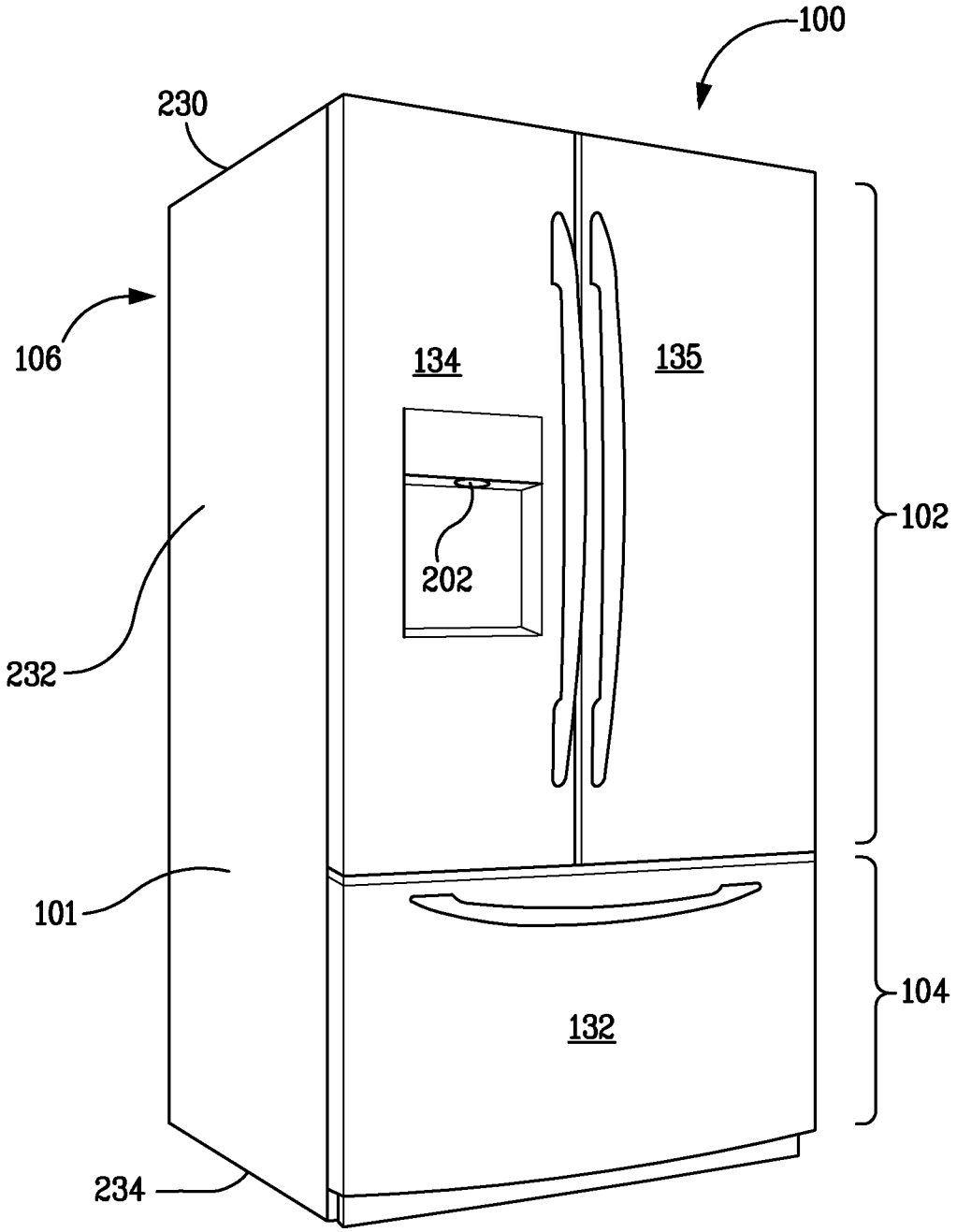
FIG. 1 is a perspective view of a refrigerator in accordance with an exemplary embodiment of the invention.
Figure 2:
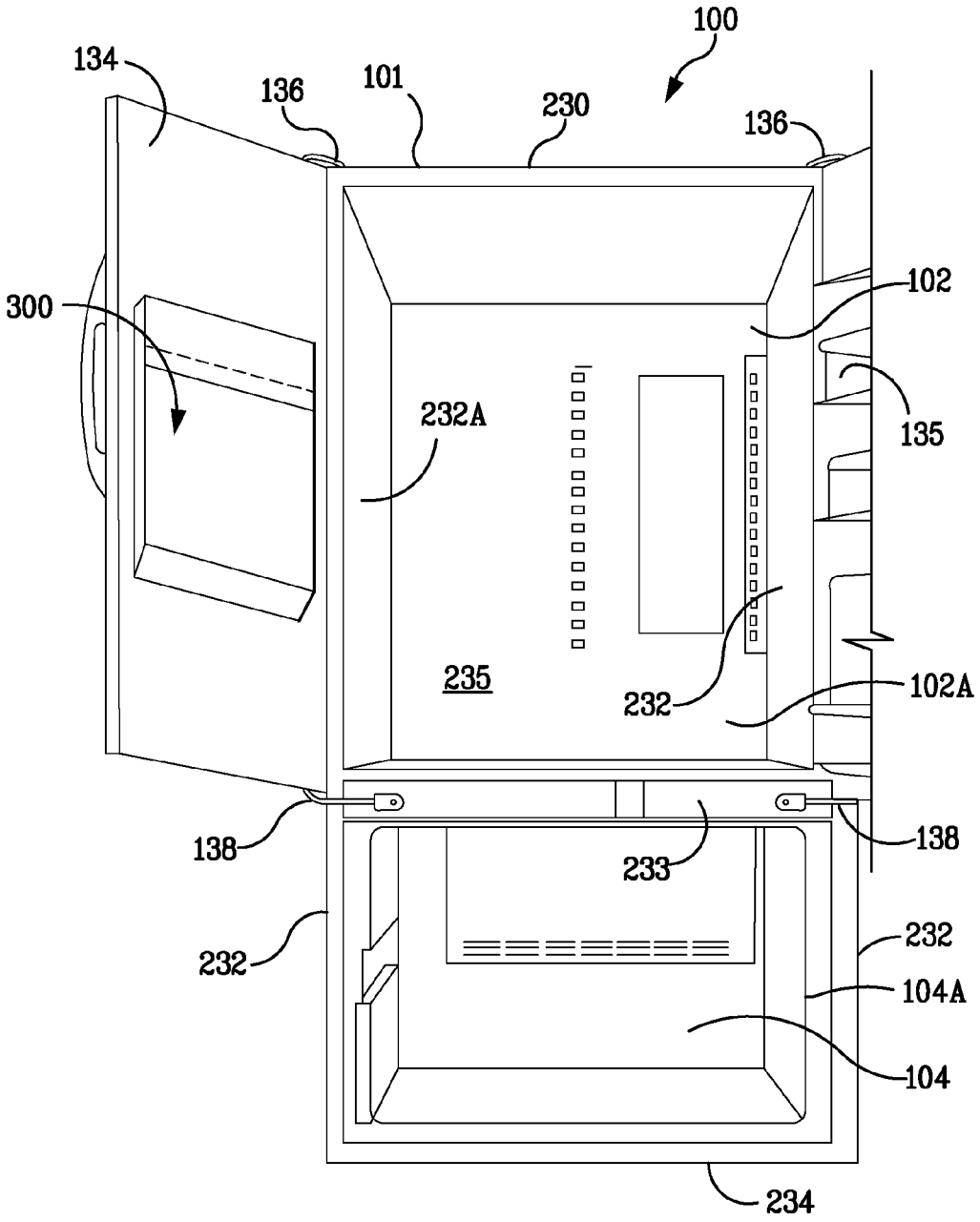
FIG. 2 is a perspective view of the refrigerator of FIG. 1 with the doors for the fresh food compartment being open and with the drawer/door for the freezer compartment being removed.

Referring now to FIGS. 1 and 2, a refrigerator in accordance with an exemplary embodiment of the invention is generally designated by reference numeral 100. The refrigerator 100 has a main body 101 which defines therein a first, upper, fresh food compartment 102 with a frontal access opening 102A and a second, lower, freezer compartment 104 with a frontal access opening 104A. The fresh food compartment 102 and the freezer compartment 104 are arranged in a bottom mount configuration where the fresh food compartment 102 is disposed or positioned above the freezer compartment 104. The fresh food compartment 102 is shown with two French doors 134 and 135. However, a single door can be used instead of the doors 134, 135. The freezer compartment 104 can be closed by a drawer or a door 132.

The main body 101 of the refrigerator 100 includes a top wall 230 and two sidewalls 232. The top wall 230 connects the sidewalls 232 to each other at the top ends thereof. A mullion 233, best shown in FIG. 2, connects the two sidewalls 232 to each other and separates the fresh food compartment 102 from the freezer compartment 104. The main body 101 also includes a bottom wall 234, which connects the two sidewalls 232 to each other at the bottom ends thereof, and a back wall 235. As is known in the art, at least each of the sidewalls 232 includes an outer case 232A, a liner 232B, and a thermal insulation layer 232C disposed between the outer case 232A and the liner 232B (see FIG. 7). The thermal insulation layer 232C is made of a thermal insulation material such as a rigid polyurethane or other thermoset foam.

The drawer/door 132 and the doors 134, 135 close the frontal access openings 104A, 102A, respectively.

Each of the doors 134, 135 is mounted to the main body 101 by a top hinge 136 and a bottom hinge 138, thereby being rotatable approximately around the outer vertical edge of the fresh food compartment 102 between an open position for accessing the respective part of the fresh food compartment 102, as shown in FIG. 2, and a closed position for closing the respective part of the fresh food compartment 102, as shown in FIG. 1.

Similarly, when an access door 132 is used for the freezer compartment 104, it is rotatably attached to the main body 101 in a similar fashion. When a drawer is used for the freezer compartment 104, it is slidably received in the interior or cavity defined by the freezer compartment 104 in a known fashion.

Figure 3:
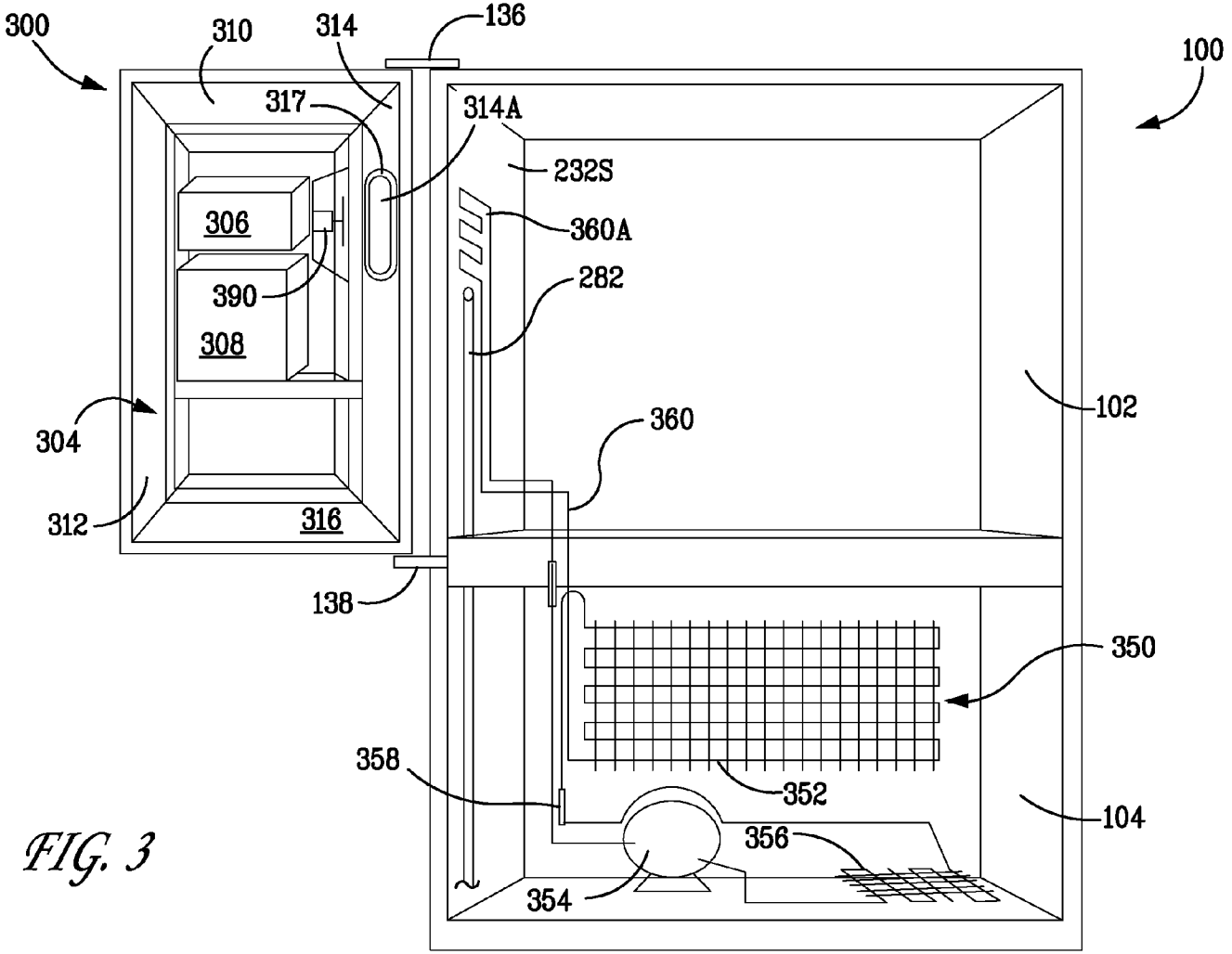
FIG. 3 partially and schematically shows some of the components of the refrigerator of FIG. 1, with one fresh food compartment door open and the other being removed and the door for the sub-compartment and the drawer/door for the freezer compartment being removed.
Figure 4:
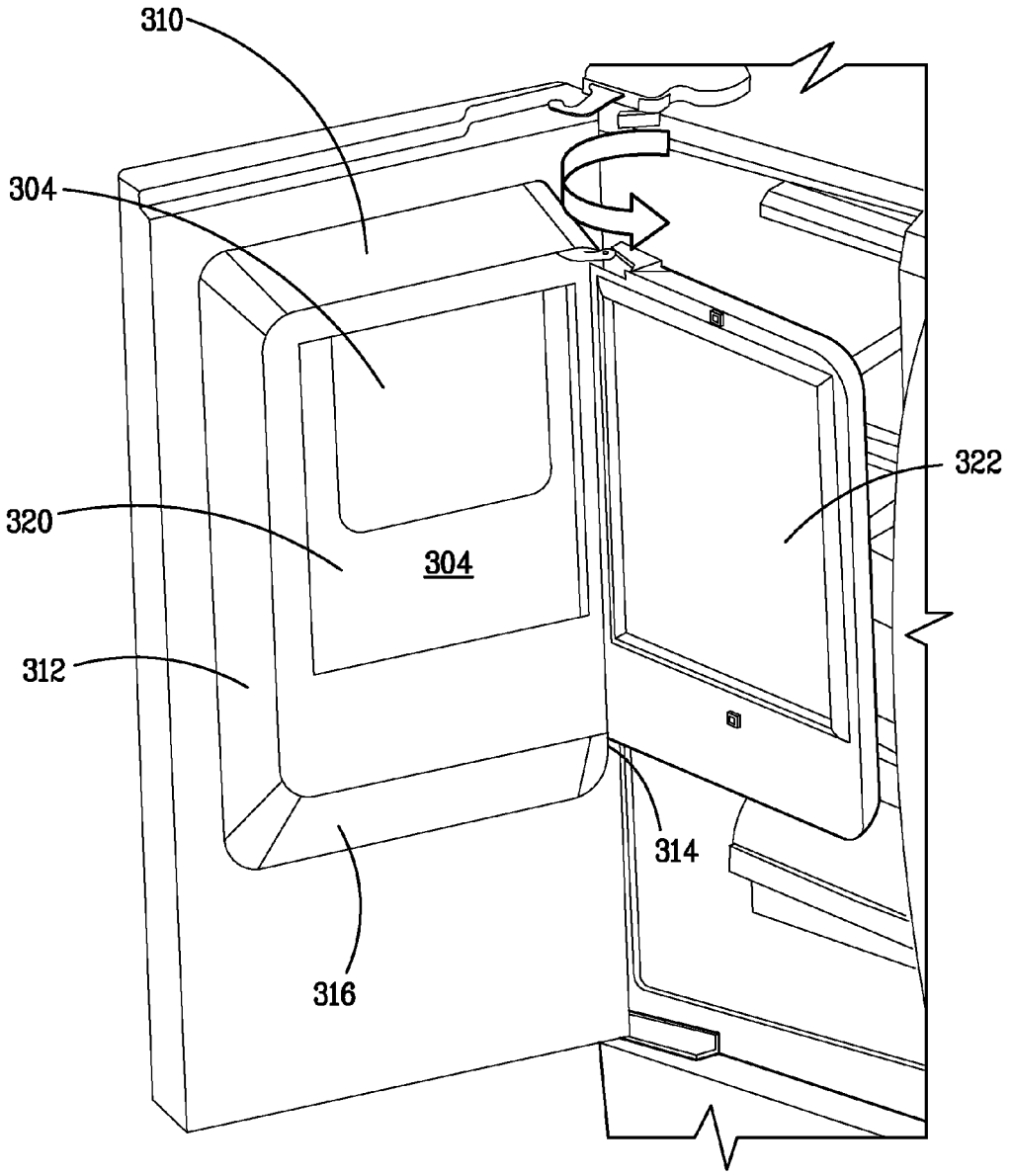
FIG. 4 is a perspective, partial view of a fresh food compartment door of the refrigerator of FIG. 2.

As shown in FIGS. 2-4, an ice-making section 300 for freezing water and selectively discharging ice is mounted on the door 134 for the fresh food compartment 102. The ice-making section 300 is disposed substantially in the fresh food compartment 102 when the door 134 is the closed position. The ice-making section 300 delivers ice through a chute formed in the door 134. The chute extends downward and/or outward from the ice-making section 300, with its lower end 202 being accessible from the exterior surface side of the door 134 (see FIG. 1). The lower end 202 is preferably positioned at a height facilitating convenient access to the ice. Of course, the ice-making section 300 can be mounted on the door 135 instead.

Figure 5:
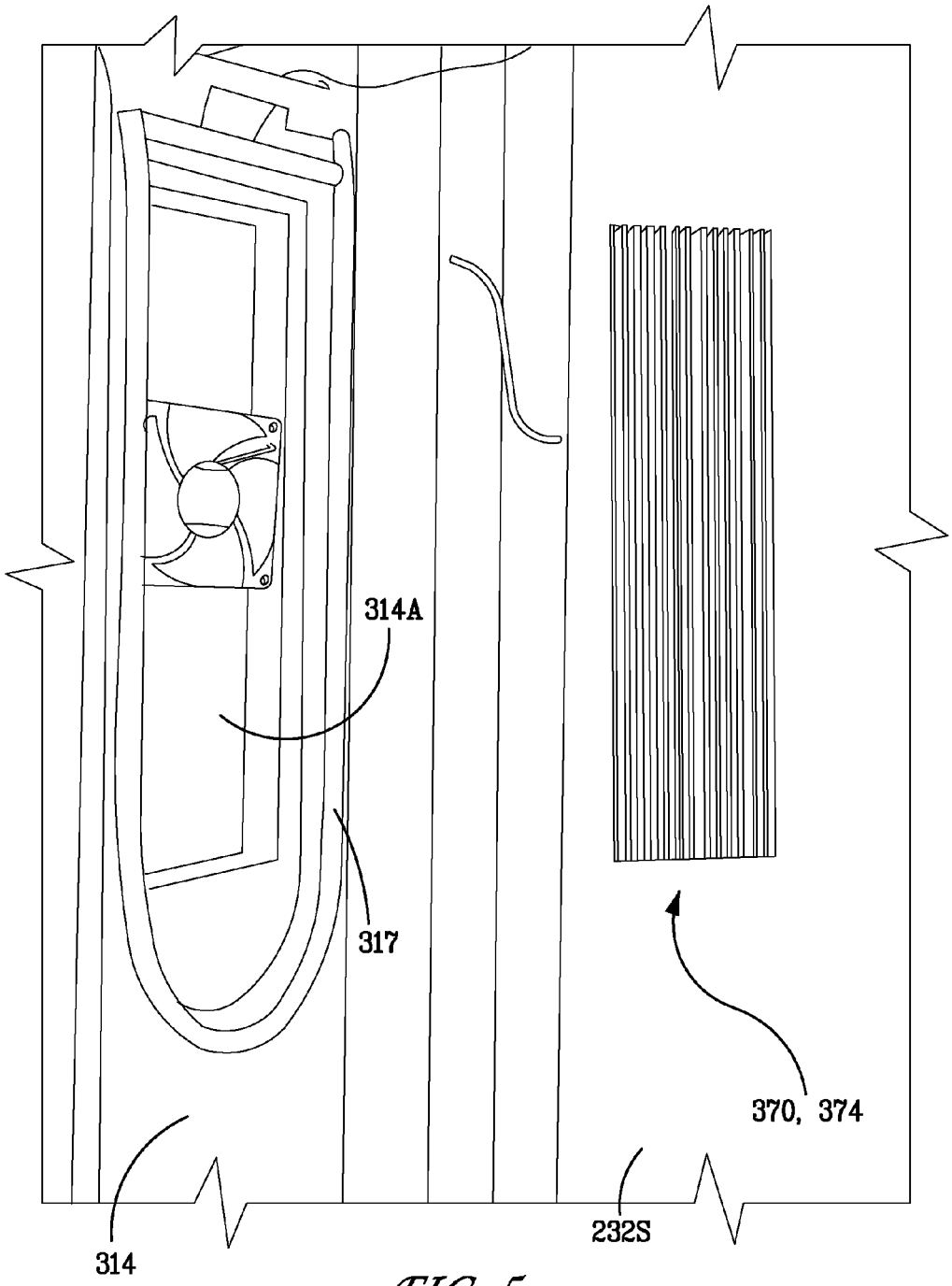
FIG. 5 is an enlarged, perspective view of the opening of the sub-compartment and the heat exchanger of the refrigerator of FIG. 2.

As illustrated in FIGS. 3-5, the ice-making section 300 includes an ice sub-compartment 304 mounted on or partially formed by the liner of the door 134, an icemaker 306 disposed in the sub-compartment 304, and preferably an ice storage bin 308 disposed in the sub-compartment 304 and below or underneath the icemaker 306. Since the fresh food compartment 102 normally has a temperature higher than the freezing point of water, the sub-compartment 304 is preferably thermally insulated to prevent or substantially reduce the undesired heat transfer between air in the sub-compartment 304 and the air in the fresh food compartment 102. The sub-compartment 304 has a top wall 310, two sidewalls 312, 314, a bottom wall 316, a front wall 318, and a back wall that can be formed by the inner liner of the door 134. Preferably, the front wall 318 has an opening 320, and an access door 322 is pivotably or rotatably mounted to the front wall 318 in a known fashion for selectively closing the opening 320. To facilitate cooling the ice sub-compartment 304, the sidewall 314, which faces the sidewall 232S of the fresh food compartment 102 when the door 134 is closed, has an opening 314A. A gasket 317 is attached to the sidewall 314 and surrounds the opening 314A. The function of the opening 314A and the gasket 317 will be discussed in detail below.

As is known in the art, water is delivered to one or more ice molds (not shown) of the icemaker 306 through a water supply conduit (not shown) and then frozen into ice cubes. After frozen, the ice cubes may be discharged from the ice molds and stored in the ice storage bin 308 until needed by a user. The ice cubes may be withdrawn by accessing the ice storage bin 308 through the access door 322. The ice cubes, however, are typically dispensed via the chute by an ice-dispensing device (not shown) installed in the door 134.

Referring now to FIG. 3, the refrigeration system 350 of the refrigerator 100 is preferably a single evaporator system. The sealed system includes evaporator 352 disposed in the freezer compartment 104, a compressor 354 disposed downstream of the evaporator 352 and outside of the freezer compartment 104, a condenser 356 disposed downstream of the compressor 354, an expansion valve 358 disposed downstream of the condenser 356, and a fluid connection loop 360 fluidly connecting these elements 352-358 together. The refrigeration system 350 contains therein a working medium (i.e., the refrigerant). Unlike known refrigerators, however, the fluid connection loop 360, which fluidly connects the evaporator 352 to the compressor 354 for transmitting the refrigerant therebetween, includes a serpentine portion 360A (i.e., the cooling serpentine) disposed or embedded in the sidewall 232S of the fresh food compartment 102 at a location proximate the opening 314A in door 134 when the door 134 is closed. By this arrangement, the serpentine portion 360A can be used to cool the ice sub-compartment 304 as hereinafter described.

Figure 6:
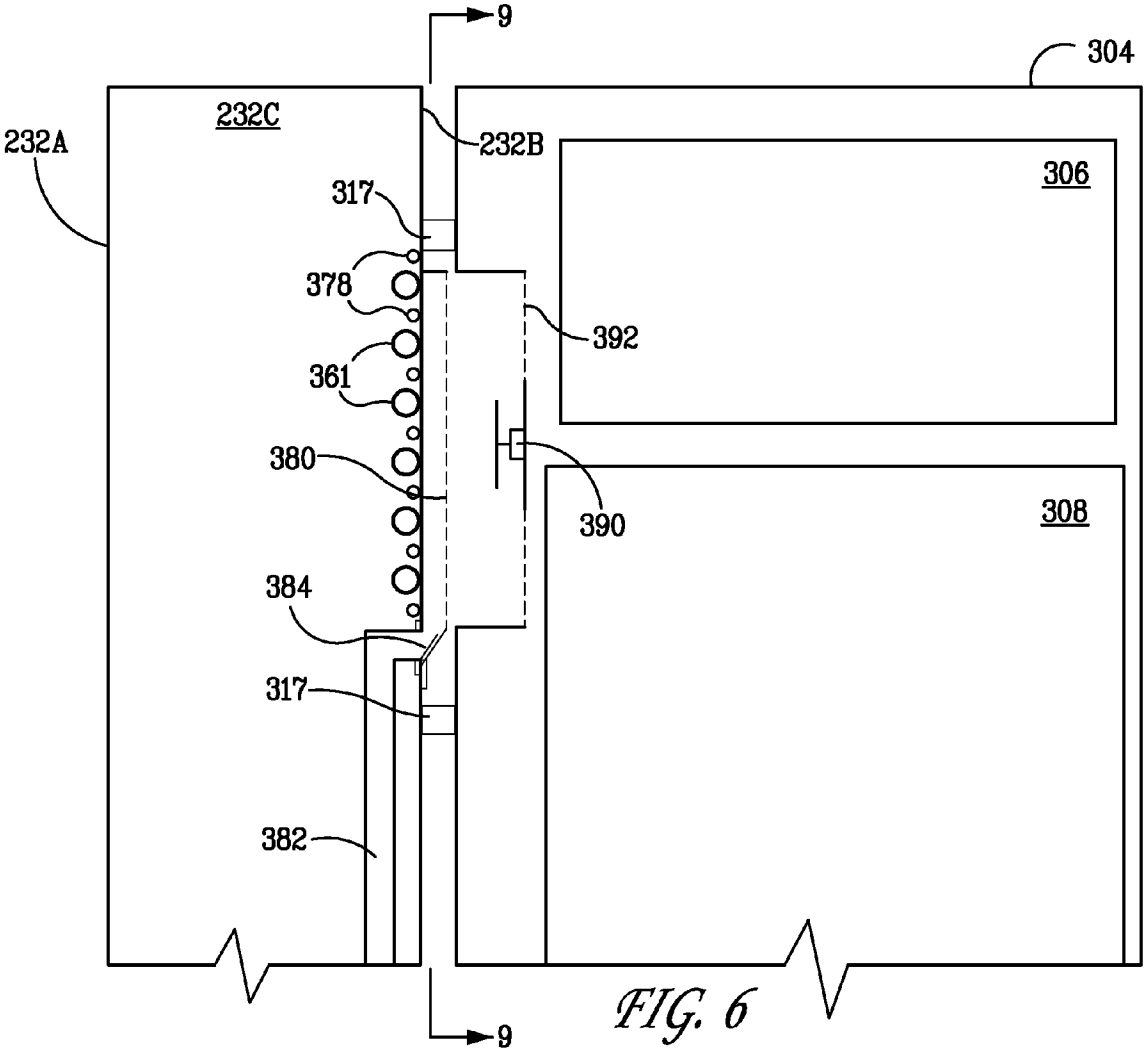
FIG. 6 is a partial, schematic view of the heat exchanger and the sub-compartment of the refrigerator of FIG. 2 with the fresh food compartment door being closed.
Figure 7:
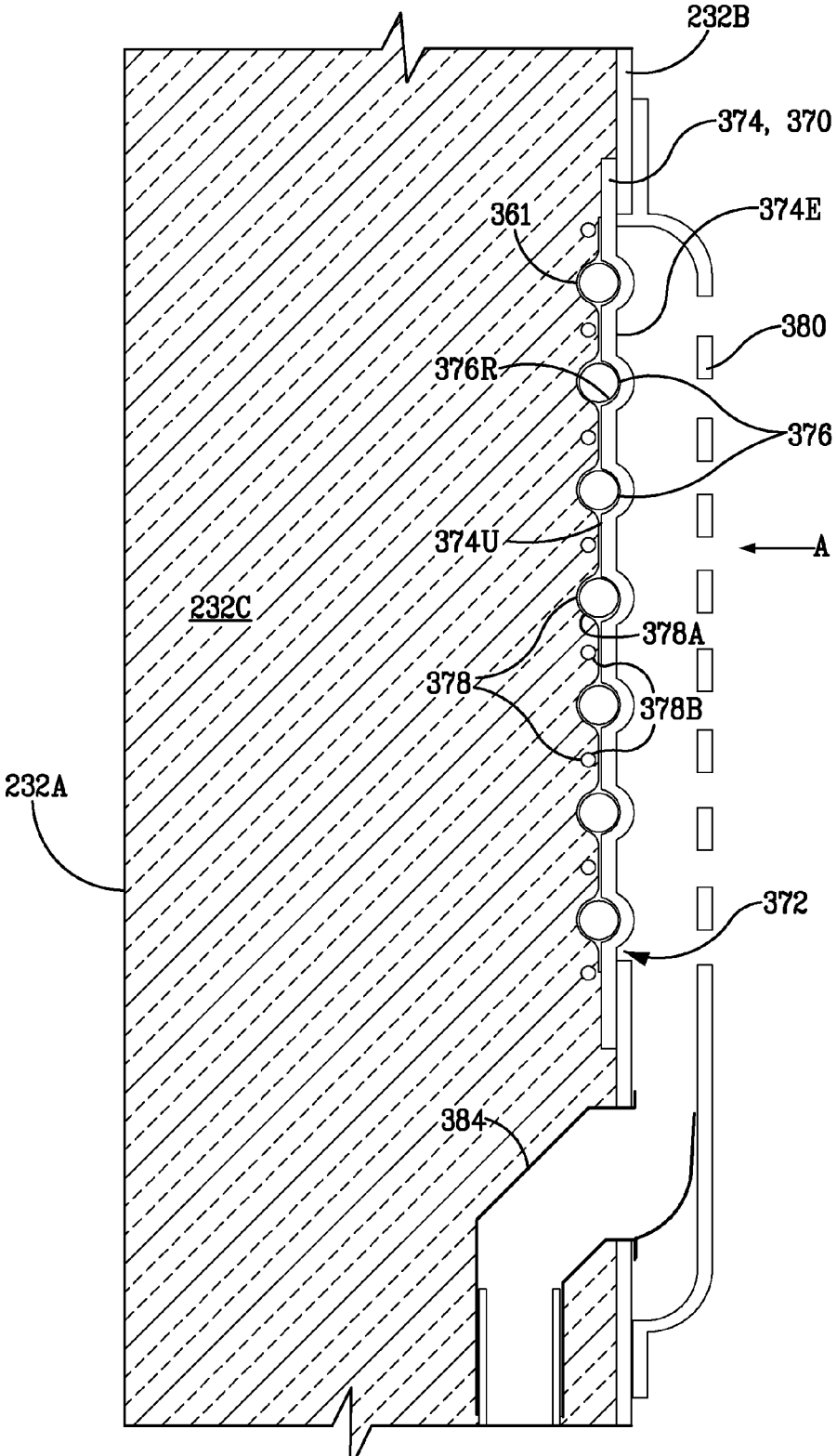
FIG. 7 is an enlarged, schematic view of the heat exchanger of FIG. 6.

As shown in FIGS. 6 and 7, the liner 232B of the sidewall 232S of the fresh food compartment 102 has an opening 372 that preferably faces or is substantially aligned with the opening 314A of the sidewall 314 of the sub-compartment 304 when the door 134 is in the closed position. In one embodiment, a heat exchanger 370, comprising a formed metal heat-exchanging plate 374, is attached to the liner 232B and covers the opening 372. The heat exchanger 370 is thermally coupled to the serpentine portion 360A so that the refrigerant, when passing through the serpentine portion 360A, cools the heat exchanger 370. As best illustrated in FIG. 6, when the door 134 is closed, the heat-exchanging plate 374 is substantially aligned with the opening 314A, the gasket 317 touches/presses the sidewall 232S and surrounds the heat-exchanging plate 374 so that the heat-exchanging plate 374 is exposed to the interior of the sub-compartment 304 while the gasket 317 substantially seals the heat-exchanging plate 374 and the interior of the sub-compartment 304 from the rest of the fresh food compartment 102. In other words, when the door 134 is closed, part of the sidewall 232S including the heat-exchanging plate 374, the gasket 317 and the sub-compartment 304 form or define a substantially sealed interior space.

Referring still to FIGS. 6 and 7, preferably, the portion 360A of the fluid connection loop 360 has a plurality of bent sections 361. The heat-exchanging plate 374 preferably has a plurality of projections 376 which extend outward from its first, exposed surface 374E. Preferably, each of the projections 376 has a curved cross-section (substantially semi-spherical cross sections are shown in FIG. 7) so that the projections 376 also define receiving channels 376R on the second, un-exposed, foam-facing surface 374U of the heat-exchanging plate 374 for receiving the respective bent sections 361. Such projections 376 enhance not only the heat exchange between the bent sections 361 and the heat-exchanging plate 374, but also the heat exchange between the heat-exchanging plate 374 and the air in the sub-compartment 304.

Figure 8:
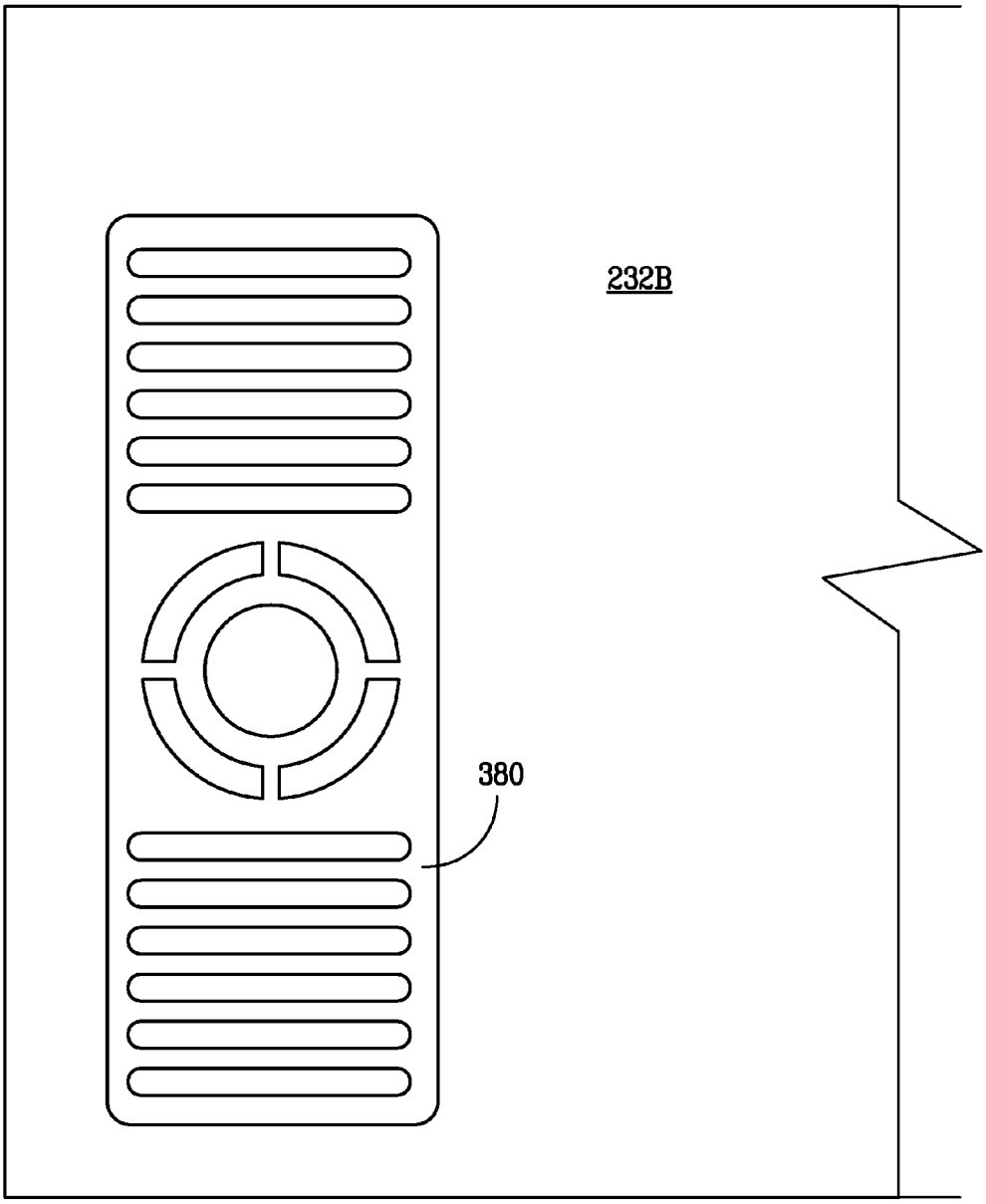
FIG. 8 is an enlarged, schematic view in the direction of arrow A in FIG. 7.

As shown in FIGS. 6-8, an appearance enhancing louvered cover 380 is preferably used to cover the heat-exchanging plate 374. The louvered cover 380, which is supported by the liner 232B, is spaced apart from the heat-exchanging plate 374.

Preferably, a defrost heater can be thermally coupled to the heat-exchanging plate 374 to remove frost that may form on the exposed surface of plate 374. In one embodiment, an aluminum foil defrost heater 378 comprising foil layer 378A and resistive heater coils 378B, is used to defrost the heat-exchanging plate 374. In this embodiment, the bent sections 361 of the serpentine portion 360A are sandwiched between the heat-exchanging plate 374 and the layer of aluminum foil that overlays the foam-facing surface 374U of plate 374. A drain tube 382, preferably embedded in the sidewall, with an inlet proximate the lower end of the heat-exchanging plate 374, is provided for directing the defrost water to a drain pan (not shown) which may be the evaporator drain pan. As shown in FIG. 7, a scoop 384 is located proximate the lower ends of the heat-exchanging plate 374 and the louvered cover 380 for directing the defrost water from the heat-exchanging plate 374 and the louvered cover 380 into the drain tube 382. The scoop 384 may have a configuration that covers the entire width of the heat-exchanging plate 374 and the entire width of the louvered cover 380. Preferably the scoop 384 is made of a flexible material such as rubber of soft plastic so as to not interfere with the door foaming process.

Figure 9:
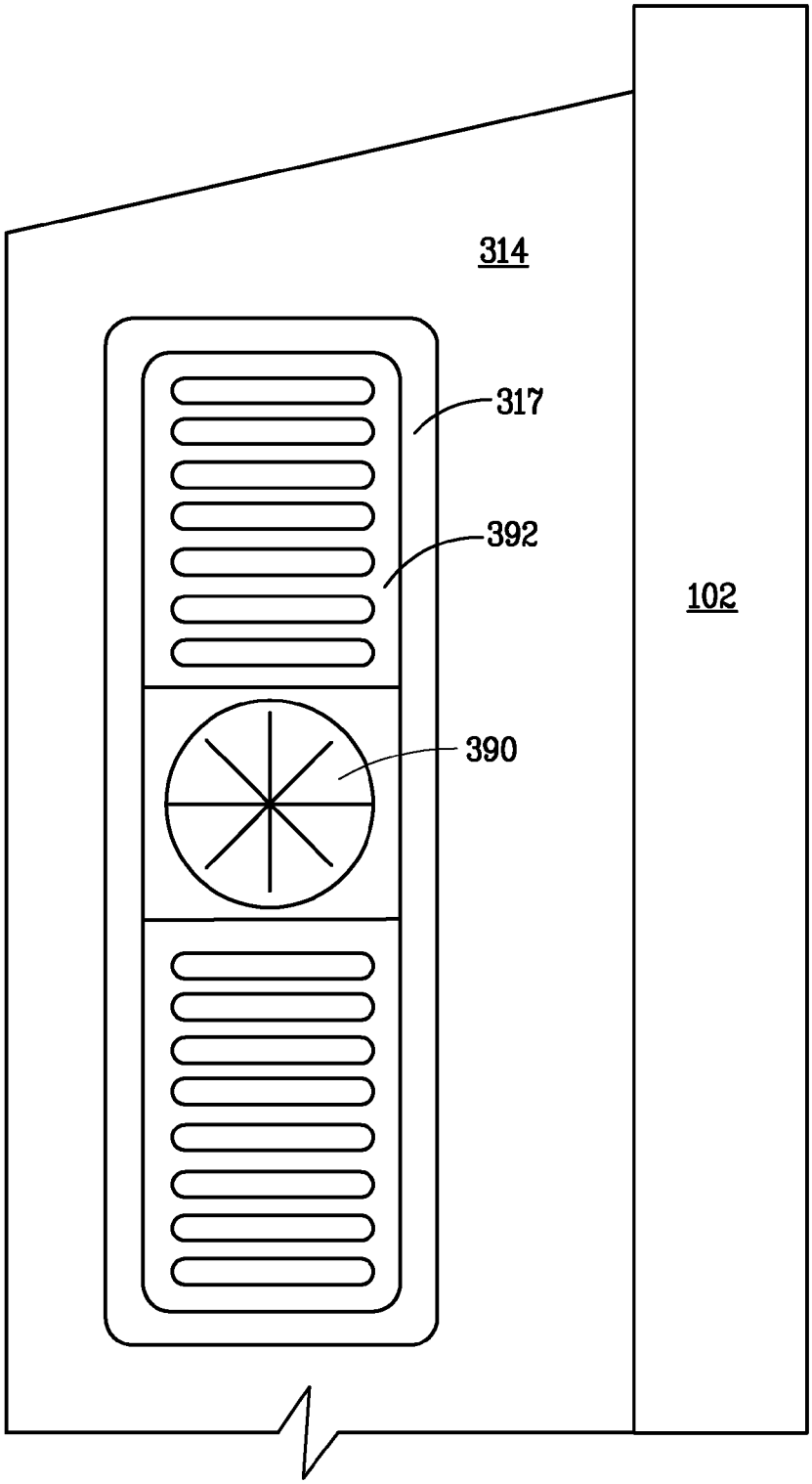
FIG. 9 is an enlarged, schematic side view of a portion of the fresh food compartment door of FIG. 6, viewed along line 9-9 in FIG. 6.

Referring now to FIGS. 5 and 6, an electric fan 390 is located in the sub-compartment 304 for facilitating the heat exchange between the air in the sub-compartment and the heat-exchanging plate 374 when the door 132 is closed. Preferably, the fan is disposed adjacent to the opening 314A. As shown in FIGS. 6 and 9, a louvered fan bracket 392 is preferably used to at least partially cover the opening 314A and to support the fan 390. The fan 390 directs air in an axial direction toward the exposed surface of the plate 374. As the air then moves radially over the exposed surface of the plate 374, cooled by the coolant passing through the cooling serpentine 360A, heat is absorbed by the plate 374 and the chilled air recirculates through the ice sub-compartment 304. By this arrangement, the air in the ice sub-compartment 304 is chilled sufficiently to form ice in the icemaker.

The icemaker 306, the defrost heater 378 and the fan 390 may be powered by a common power source or by a dedicated power source of their own.

Figure 15:
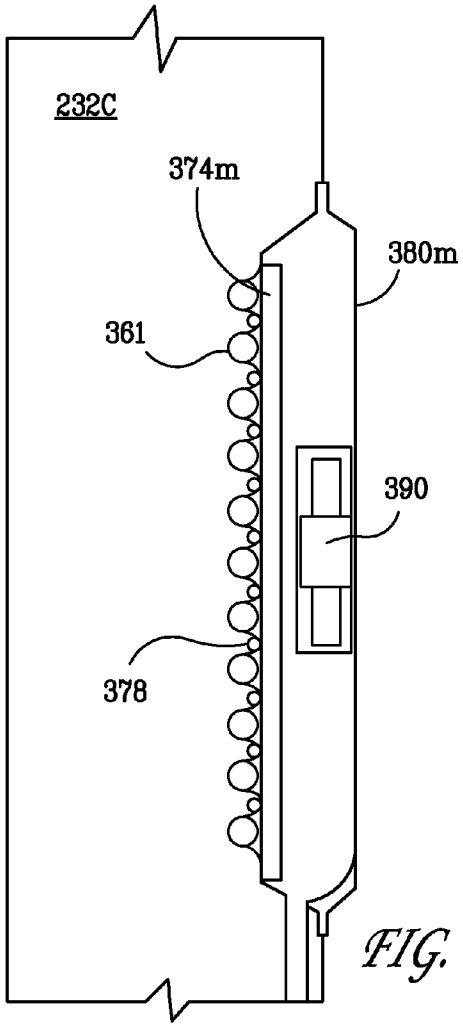
FIGS. 14 and 15 schematically show a heat exchanger in accordance with a fifth exemplary embodiment of the invention and its modified cover.
Figure 14:
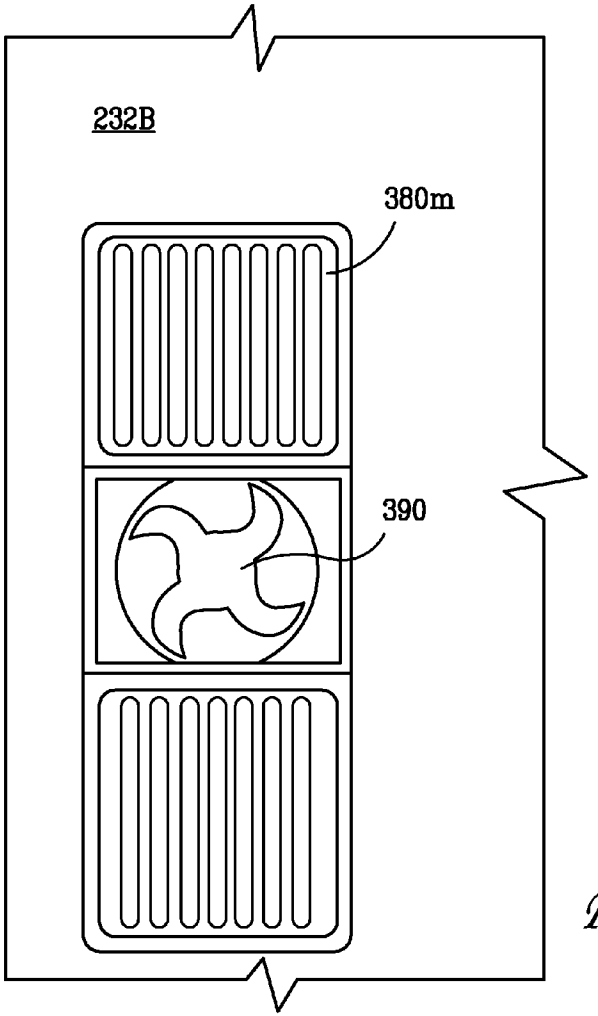

The heat-exchanging plate 374 can have different configurations. For instance, FIGS. 10 and 11 show a modified heat-exchanging plate 374', which has a plurality of short projections 376S and a plurality of long projections 376L, all projecting or extending outward from the exposed surface 374E'. The heat-exchanging plate 374' also has a plurality of projections 376B extending outward from the un-exposed surface 374U'. Each of the projections 376B forms a receiving channel 376R' for receiving a respective bent section 361. FIG. 12 shows another modified heat-exchanging plate 374" which has essentially flat surfaces without any projections. The heat-exchanging plate 374" can be attached to the inner side of the liner 232B" which has no opening 372. In this configuration, the heat-exchanging plate 374" and at least part of the liner 232B" attached to the heat-exchanging plate 374" can be considered to form the heat exchanger 370" because both become cold when the refrigerant passes through the serpentine portion 360A. FIG. 13 shows yet another modified heat-exchanging plate 374'", which has fin-shaped projections 376'" extending outward from its exposed surface 374E'" and projections that are similar to those shown in FIGS. 10 and 11 that extend outward from its un-exposed surface 374U'". FIG. 15 schematically shows yet another modified heat-exchanging plate 374*m* and its louvered cover 380*m*. As clearly illustrated in FIGS. 14 and 15, in this embodiment, the fan 390 is supported in the case side wall 232, by the louvered cover 380*m*, and preferably disposed between the louvered cover 380*m* and the heat-exchanging plate 374*m*.

Figure 16:
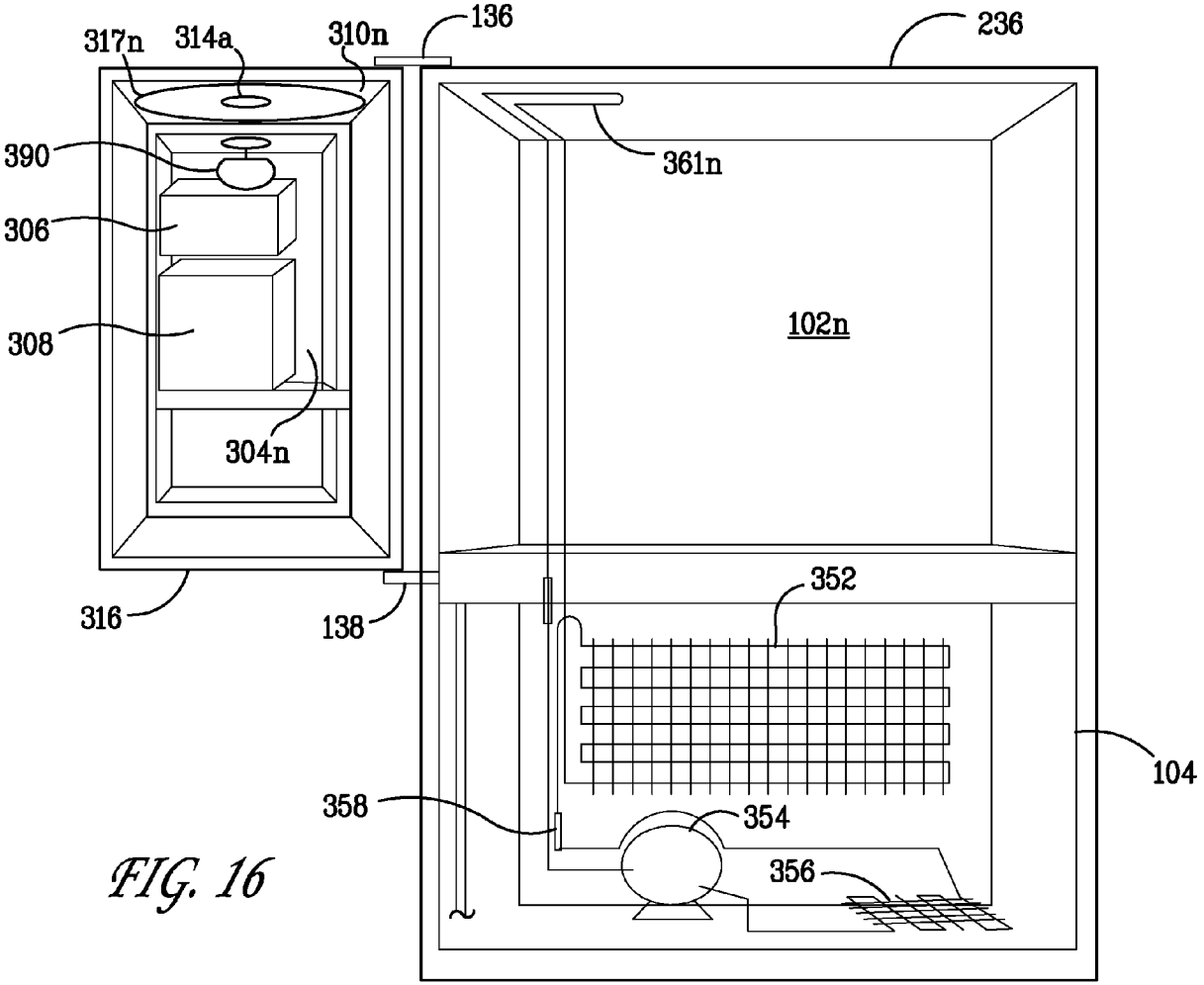
FIG. 16 is similar to FIG. 3, illustrating an alternative embodiment in which the heat exchanger is located above the fresh food compartment door.

Furthermore, the locations of the heat exchanger 370, the bent sections 361 and the opening 314A can be changed. The bent sections 361 and the heat exchanger 370 can be on any of the walls of the fresh food compartment 102. FIG. 16 shows that the bent sections 361*n* are supported by the top wall 236 of the fresh food compartment 102*n*. The heat exchanger (not shown in FIG. 16) is supported by the top wall 236 as well, and the opening 314A is formed on the top wall 310*n* of the sub-compartment 304*n*. The gasket 317*n* is mounted on the top wall 310*n*. Of course, the gasket 317*n* can be mounted on the top wall 236 of the fresh food compartment 102*n* instead. The fan 390 is shown disposed in the sub-compartment 304*n*. As discussed earlier, it can be supported by either the louvered cover (not shown in FIG. 16) for the heat exchanger or the louvered fan bracket (not shown in FIG. 16).

Figure 17B:
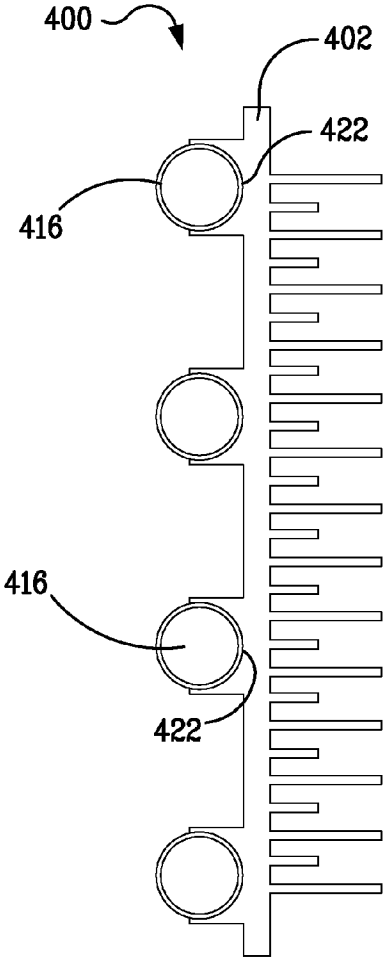
FIGS. 17-21 show additional heat exchangers in accordance with the disclosed embodiments.
Figure 17A:
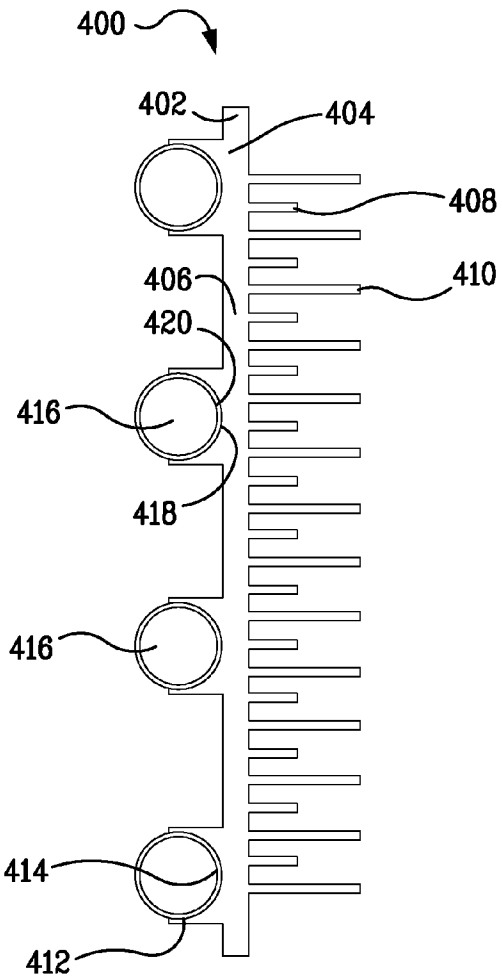

FIG. 17A shows another embodiment of a heat exchanger 400. Similar to the embodiments described above, the heat exchanger 400 includes a heat exchanging plate 402 with a first surface 404 which may be exposed to the interior of the sub-compartment 304, and a second surface 406 which may be unexposed and facing the thermal insulation layer 232C. The heat-exchanging plate 402 may have a plurality of short projections 408 and a plurality of long projections 410 projecting or extending outward from the first exposed surface 404. Other embodiments of the first exposed surface 404 may include any suitable arrangement of projections or may have no projections. The heat-exchanging plate 402 may also have a plurality of projections 412 extending outward from the second un-exposed surface 406. A plurality of the projections 412 may have a curved cross section and may form one or more receiving channels 414 for receiving one or more segments 416 of the serpentine portion 360A of the refrigeration system 350. The one or more segments 416 of the serpentine portion 360A may be made of any suitable material, for example copper or steel, and may have a tubular shape. As disclosed above, a working medium or refrigerant passes through the serpentine portion 360A and the one or more segments 416 to cool the heat exchanger 400. The heat exchanging plate 402 may be constructed of aluminum or any other suitable material. In at least one embodiment, the heat-exchanging plate 402 may be constructed as an extrusion for ease of manufacturing. In another embodiment, the heat-exchanging plate 402 may be constructed as a die cast piece. A heat transfer compound 418, for example, a thermal grease, may be applied at the interface 420 between the one or more segments 416 and the heat-exchanging plate 402. The heat transfer compound 418 may include an adhesive for fastening the segments 416 within the receiving channels 414.

FIG. 17B shows another embodiment of the heat exchanger 400 where the one or more segments 416 may be assembled with the heat-exchanging plate 402 by vacuum brazing. For example, the one or more segments 416 may be assembled with the heat-exchanging plate 402 and a suitable filler material or brazing alloy 422. The heat exchanger 400 may be placed in an oven at less than atmospheric pressure and heated to a suitable temperature to effect the vacuum brazing.

Figure 18B:
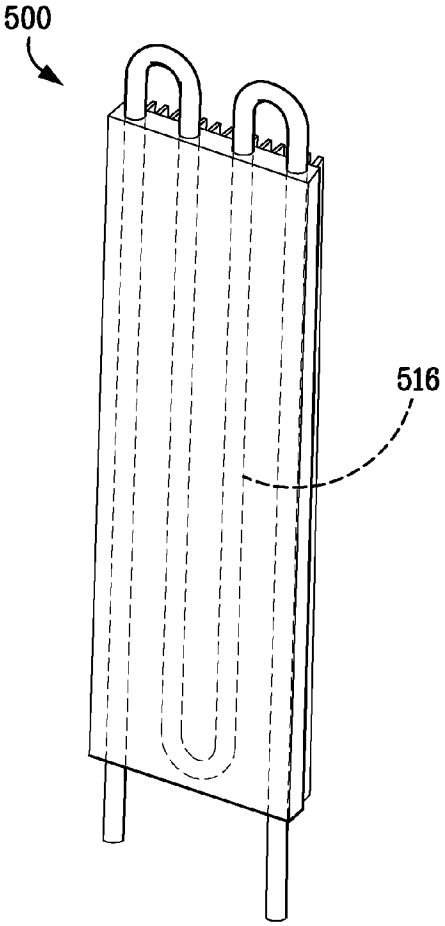
Figure 18A:
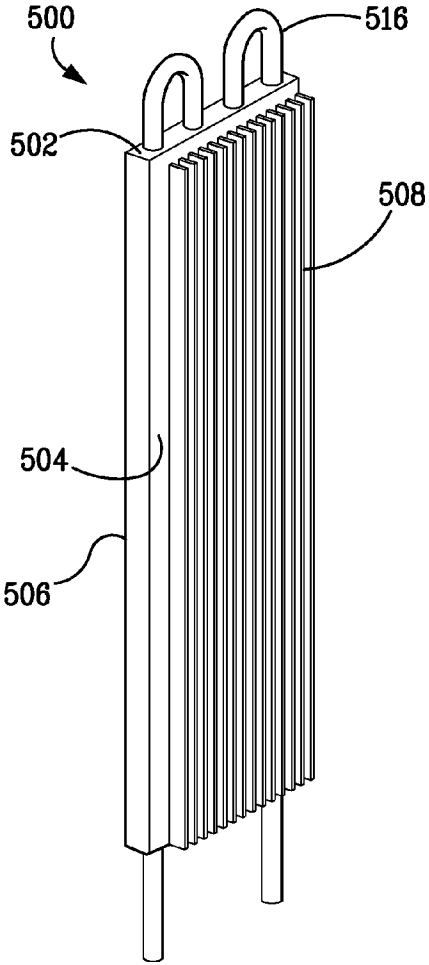

FIG. 18A depicts another embodiment of a heat exchanger 500 having a heat exchanging plate 502 with a first surface 504 which may be exposed to the interior of the sub-compartment 304, and a second surface 506 which may be unexposed and facing the thermal insulation layer 232C. The heat-exchanging plate 502 may have a plurality of projections 508 projecting or extending outward from the first exposed surface 504. In other embodiments, the first exposed surface 504 may include any suitable arrangement of projections or may have no projections. The second unexposed surface 506 may have no projections and may be a flat surface. In this embodiment, one or more segments 516 of the serpentine portion 360A may be embedded within the heat-exchanging plate 502, for example, by over-moulding. The one or more segments 516 of the serpentine portion 360A may be placed in a mould. A suitable material for the heat-exchanging plate 502 may introduced into the mould and may surround the one or more segments 516. Generally the melting point of the material of the one or more segments 516 will exceed the melting point of the material for the heat-exchanging plate 502. FIG. 18B shows a cross sectional view of the heat exchanger 500 with the segments 516 moulded within the heat-exchanging plate 502. Exemplary materials for the one or more segments 516 of the serpentine portion 360A may include copper or steel, while exemplary materials for the heat-exchanging plate 502 may include aluminum. The embodiments of FIGS. 18A and 18B provide an enhanced thermal interface between the one or more segments 516 and the heat-exchanging plate 502 and results in a single assembly of the one or more segments 516 and the heat-exchanging plate 502.

Figure 19B:
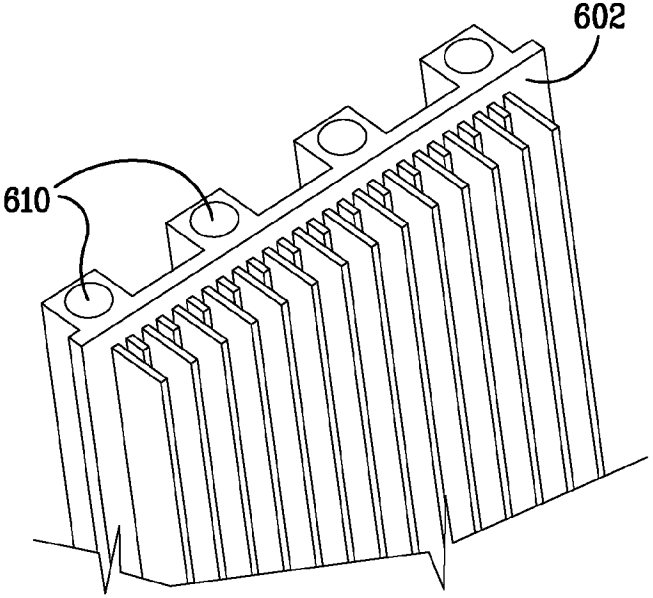
Figure 19A:
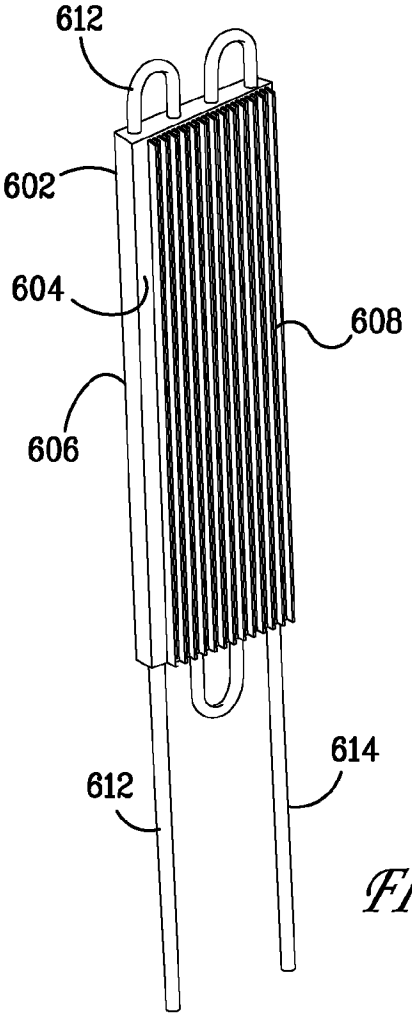

FIGS. 19A and 19B show yet another embodiment of a heat exchanger 600. Similar to other heat exchanger embodiments, the heat exchanger 600 includes a heat exchanging plate 602 with a first surface 604 which may be exposed to the interior of the sub-compartment 304, and a second surface 606 which may be unexposed and facing the thermal insulation layer 232C. The heat-exchanging plate 602 may have any suitable arrangement of projections 608 projecting or extending outward from the first exposed surface 604 or may have no projections. The second unexposed surface 606 may have no projections and may be a flat surface. One or more segments 616 of the serpentine portion 360A may be formed by a combination of one or more through channels 610 integrally formed in the heat exchanging plate 602 and a plurality of tubes 612 inserted into ends of the channels 610. The tubes 612 may be formed to connect the channels 610 to provide a single path through the exchanging plate 602 having an inlet 612 and an outlet 614. The one or more segments 616 of the serpentine portion 360A may be made of, for example, copper or steel, while the heat-exchanging plate 502 may be made of, for example, aluminum. In this embodiment, the working medium or refrigerant is thermally coupled directly to the heat-exchanger 600.

Figure 20A:
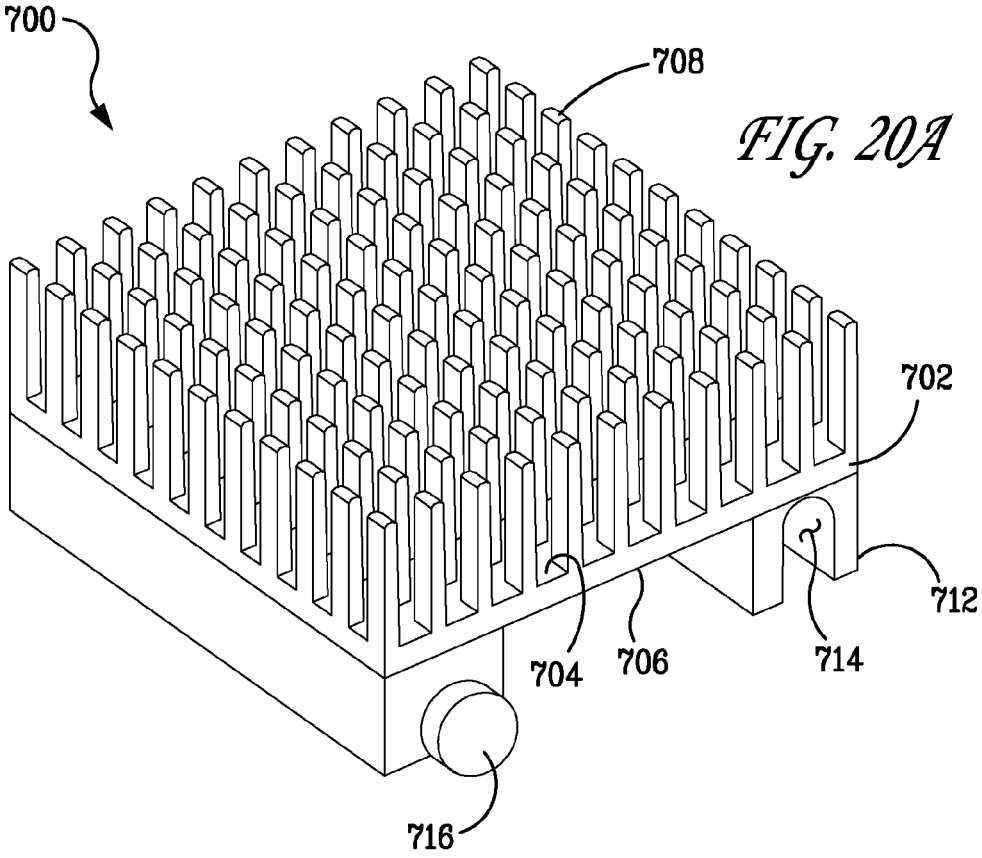
Figure 20B:
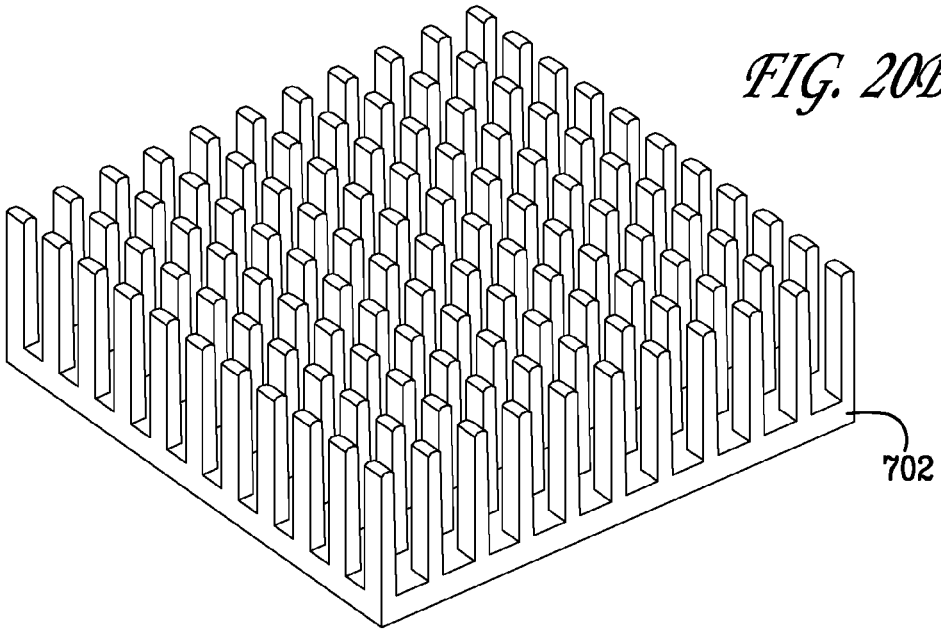

FIG. 20A shows still another embodiment of a heat exchanger 700 including a heat exchanging plate 702 with a first surface 704 which may be exposed to the interior of the sub-compartment 304, and a second surface 706 which may be unexposed and facing the thermal insulation layer 232C. The heat-exchanging plate 702 may have a plurality of projections 708 projecting or extending outward from the first exposed surface 704. The plurality of projections 708 extending outward from the first exposed surface 704 may all have the same dimensions and each of the projections 708 may have a rectangular cuboid shape. The plurality of projections 708 may extend into the sub-compartment 304. The heat-exchanging plate 702 may optionally have a plurality of projections 712 extending outward from the second un-exposed surface 706 having a curved cross section that forms one or more receiving channels 714 for receiving one or more segments 716 of the serpentine portion 360A. In other embodiments, the heat-exchanging plate 702 may have no projections extending outward from the second un-exposed surface 706 as shown in FIG. 20B.

Figure 21:
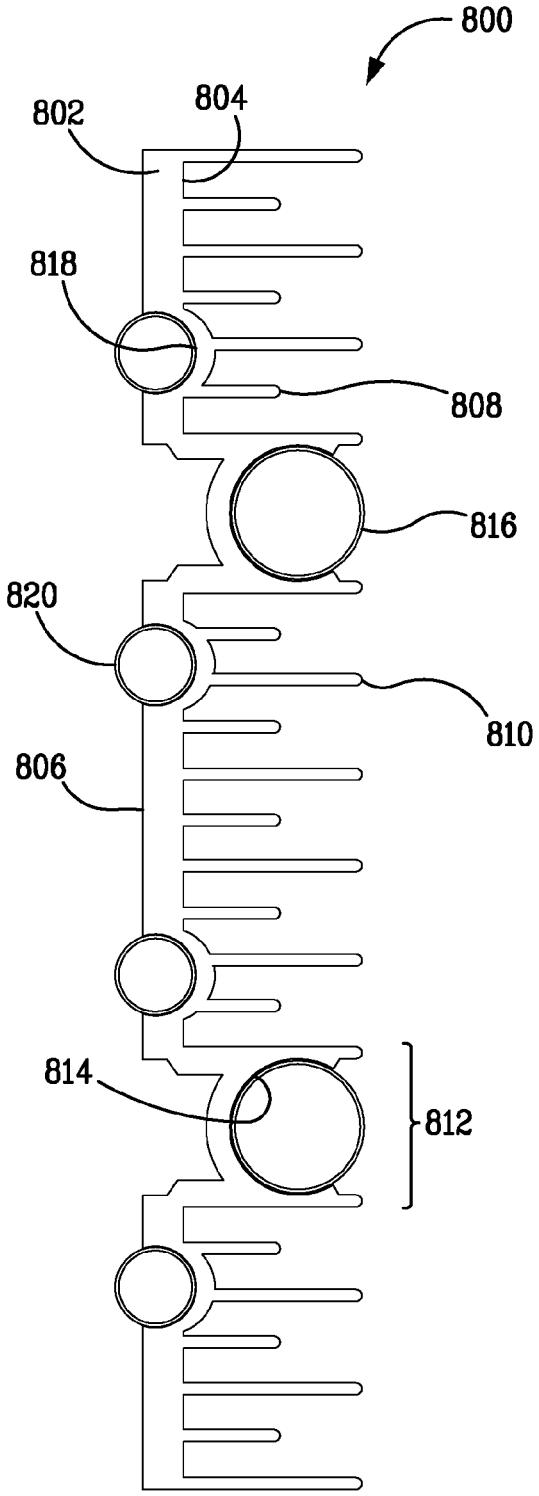

FIG. 21 shows yet another embodiment of a heat exchanger 800. The heat exchanger 800 includes a heat exchanging plate 802 with a first surface 804 which may be exposed to the interior of the sub-compartment 304, and a second surface 806 which may be unexposed and facing the thermal insulation layer 232C. The heat-exchanging plate 802 may have a plurality of short projections 808 and a plurality of long projections 810 projecting or extending outward from the first exposed surface 804. The heat-exchanging plate 802 may also have a plurality of additional projections 812 extending outward from the first exposed surface 804 having a curved cross section and may form one or more first receiving channels 814 for receiving one or more segments 816 of the serpentine portion 360A. As with other embodiments described above, the one or more segments 816 of the serpentine portion 360A may be made of any suitable material, for example copper or steel, and may have a tubular shape. The first receiving channels 814 of the heat exchanging plate 802 provide additional cooling directly to the interior of the sub-compartment 304 because they position the one or more segments 816 directly within the sub-compartment 304 allowing for additional heat transfer. The heat exchanging plate 802 may also include second receiving channels 818 provided on the second unexposed surface 806 for receiving heater coils 820 used to defrost the heat exchanging plate 802. The heat exchanging plate 802 may be constructed of aluminum or any other suitable material. The heat-exchanging plate 802 may also be constructed as an extrusion or as a die cast piece.

The thermal interface between the segments 416, 516, 616, 716, 816 and the respective heat exchanging plates 402, 502, 602, 802 may be further enhanced by assembling a respective set of segments and heat exchanging plate and dipping the assembly in a molten zinc bath.

Thus, while there have shown, described and pointed out fundamental novel features of the invention as applied to preferred embodiments thereof, it will be understood that various omissions, substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A refrigerator comprising:

a main body defining a compartment, the compartment having an access opening and a first wall;

a door supported by the main body for selectively closing at least part of the access opening;

a sub-compartment on the door, the sub-compartment comprising a second wall having an opening;

a heat exchanger supported by the first wall and positioned so that when the door is closed the heat exchanger is exposed to an interior of the sub-compartment through the opening, the heat exchanger comprising a heat exchanging plate with a first surface exposed to the interior of the sub-compartment when the door is closed and a second surface on an opposite side of the heat exchanging plate from the first surface, the heat exchanging plate comprising a plurality of semi-spherical projections formed by the heat exchanging plate such that the semi-spherical projections of the plurality of semi-spherical projections extend outward from the first surface of the heat exchanging plate and are exposed to the interior of the sub-compartment when the door is closed, the semi-spherical projections defining receiving channels formed by the heat exchanging plate on the second surface of the heat exchanging plate, receiving portions of the receiving channels being formed in the second surface; and a sealed refrigeration system containing a working medium for cooling the heat exchanger, and comprising a fluid connection loop between an evaporator and a condenser of the sealed refrigeration system, the fluid connection loop being attached to the heat exchanging plate, wherein the fluid connection loop comprises a serpentine portion disposed the first wall, the serpentine portion being thermally coupled to the heat exchanger, the serpentine portion comprising a plurality of bent sections that are received in the receiving channels on the second surface of the heat exchanging plate.

2. The refrigerator of claim 1, wherein first surface of the heat exchanging plate is exposed to the interior of the sub-compartment through the opening the second wall.

3. The refrigerator of claim 2, wherein the heat exchanging plate further comprises a plurality of short projections and a plurality of long projections extending outward from the first surface.

4. The refrigerator of claim 2, wherein the heat exchanging plate further comprises a plurality of projections extending outward from the first surface, the projections having the same dimensions and a generally rectangular cuboid shape.

5. The refrigerator of claim 1, wherein the second surface of the heat exchanging plate is unexposed to the to the interior of the sub-compartment.

6. The refrigerator of claim 5, wherein a plurality of projections extend outward from the second surface to form one or more receiving channels for receiving a defrost heater.

7. The refrigerator of claim 1, wherein the heat exchanging plate is constructed as an extrusion.

8. The refrigerator of claim 1, wherein the heat xchanging plate is constructed as a die cast piece.

9. The refrigerator of claim 1, further comprising a heat transfer compound applied at an interface between the bent sections and the heat-exchanging plate.

10. The refrigerator of claim 1, wherein the bent sections are assembled with the heat-exchanging plate by vacuum brazing.

11. The refrigerator of claim 1, wherein the bent sections are moulded within the heat-exchanging plate.

12. The refrigerator of claim 1, wherein the fluid connection loop comprises one or more through channels of the heat-exchanging plate connected to a plurality of tubes.

13. The refrigerator of claim 1, wherein the fluid connection loop is assembled with the heat-exchanging plate by a molten zinc dip.

14. The refrigerator of claim 1, wherein the heat exchanger comprises a plurality of fin-shaped projections extending outward from the second surface of the heat exchanging plate to define sides of the receiving channels.

15. The refrigerator of claim 14, wherein the fin-shaped projections defining sides of the receiving channels are aligned on either side of the bent sections of the serpentine portion of the fluid connection loop.

16. The refrigerator of claim 15, wherein the heat exchanger comprises a plurality of fin-shaped projections extending outward from the first surface of the heat exchanging plate.

17. The refrigerator of claim 16, wherein the plurality of fin-shaped projections extending outward from the first surface of the heat exchanging plate comprises a set of short, fin-shaped projections and a set of long, fin-shaped projections, a short, fin-shaped projection being arranged adjacent to a long, fin-shaped projection.

18. The refrigerator of claim 1, wherein the first surface of the heat exchanging plate is exposed to the interior of the sub-compartment to provide force convection cooling to the sub-compartment.

* * * * *